US006044519A

United States Patent [19]

Hendrix

[11] Patent Number: 6,044,519

[45] Date of Patent: Apr. 4, 2000

[54] PORTABLE ELECTRIC TOOL VACUUM CLEANER CONTROL

[75] Inventor: George E. Hendrix, Florissant, Mo.

[73] Assignee: Emerson Electric Co., St. Louis, Mo.

[21] Appl. No.: 08/821,327

[22] Filed: Mar. 21, 1997

Related U.S. Application Data

[63] Continuation of application No. 08/568,967, Dec. 7, 1995, abandoned.

[51] Int. Cl.[7] ..... A47L 9/28

[52] U.S. Cl. ..... 15/319

[58] Field of Search ..... 15/301, 319, 339, 15/314

[56] References Cited

U.S. PATENT DOCUMENTS

| | | | |
|---|---|---|---|
| 4,201,256 | 5/1980 | Truhan . | |
| 4,399,638 | 8/1983 | Rodowsky et al. . | |
| 4,977,638 | 12/1990 | Best . | |
| 5,075,922 | 12/1991 | Tsuchida et al. . | |
| 5,099,544 | 3/1992 | Yamamoto . | |
| 5,237,896 | 8/1993 | Albright et al. . | |
| 5,256,906 | 10/1993 | Tsuge et al. | 307/39 |
| 5,606,767 | 3/1997 | Crlenjak et al. | 15/339 X |

FOREIGN PATENT DOCUMENTS 0411855A 2/1991 European Pat. Off. .

2534169A 2/1977 Germany .

OTHER PUBLICATIONS

Porter–Cable Power Tool–Triggered Wet/Dry Vac (Model 7810), Instruction Manual, 1994 (U.S.).

Fein Random Orbit Sander With Dust Extractor, Fein High Performance Power Tools Catalog, 1990 (U.S.).

Makita Dust Collector (Model 420S), Instruction Manual, 1994 (Japan).

*Fine Woodworking*, May/Jun. 1994, Taunton Press, Newtown CT 06470, p. 104.

*Woodworker's Journal*, Nov./Dec. 1994, p. 10.

*Primary Examiner*—Chris K. Moore

*Attorney, Agent, or Firm*—Arnold White & Durkee

[57] ABSTRACT

A portable electric tool vacuum cleaner control to permit use of a vacuum cleaner independent of and in conjunction with a portable electric tool is disclosed. The vacuum cleaner control includes a motor control circuit and a motor for operating the vacuum cleaner. An electrical outlet is provided on the vacuum cleaner, which is connected to the vacuum cleaner motor control circuit, to enable a portable electric tool to be plugged into the vacuum cleaner electrical outlet. A three position on/off/automatic switch is provided on the vacuum cleaner for operating the vacuum cleaner motor control circuit to enable independent operation of the vacuum cleaner or joint operation of the portable electric tool in conjunction with the vacuum cleaner, as desired.

11 Claims, 2 Drawing Sheets

PORTABLE ELECTRIC TOOL VACUUM CLEANER CONTROL

CROSS-REFERENCE TO RELATED APPLICATION

This application is a continuation of prior application Ser. No. 08/568,967, filed Dec. 7, 1995, and now abandoned, the entire disclosure of which is incorporated herein by reference.

BACKGROUND OF THE INVENTION

I. Field of the Invention

The present invention relates to a portable electric tool vacuum cleaner control, and more particularly, to a vacuum cleaner control which permits use of a vacuum cleaner independent of and in conjunction with a portable electric tool, as may be desired.

II. Description of the Related Art

It is well-known to use various types of dust collection devices in conjunction with fixed or non-movable power tools such as woodworking machines, sanders, pneumatic tools, and the like. Examples of various types of dust collection devices or systems used with such fixed or non-movable power tools are shown in U.S. Pat. Nos. 4,201,256; 4,399,638; 4,977,638; 5,075,922; 5,099,544; and 5,237,896.

Dust collection devices or systems are not typically employed when portable electric power tools such as saws, sanders, drills and the like are utilized. Space and power requirements are several of the limitations which restrict the use of a dust collection device or system in conjunction with a portable electric tool. Of course, vacuum cleaners can be used to clean up dust and debris from such portable electric tools; however, the vacuum cleaner and the portable electric tool are operated independently from one another.

The present invention discloses a portable electric tool vacuum cleaner control which enables a vacuum cleaner to be operated both independent of as well as in conjunction with the portable electric tool, as may be desired.

SUMMARY OF THE INVENTION

The objects and advantages of the present invention include the provision of:

(a) a new and improved portable electric tool vacuum cleaner control for operating a vacuum cleaner independent of and in conjunction with the portable electric tool;

(b) the aforementioned portable electric tool vacuum cleaner control which enables a vacuum cleaner to become energized and de-energized when a portable electric tool is turned on and off;

(c) the aforementioned portable electric tool vacuum cleaner control which includes a three position ON/OFF/AUTOMATIC switch for controlling the operation between a vacuum cleaner and portable electric tool;

(d) the aforementioned portable electric tool vacuum cleaner control which includes an electrical outlet mounted on the vacuum cleaner to facilitate operation of the portable electric tool in conjunction with the vacuum cleaner;

(e) the aforementioned portable electric tool vacuum cleaner control which facilitates dust collection by a vacuum cleaner used in conjunction with a portable electric tool; and (f) the aforementioned portable electric tool vacuum cleaner control which is reliable, durable, fast-acting, self-protecting, essentially maintenance free and is otherwise well adapted for the purpose intended.

Briefly stated, the portable electric tool vacuum cleaner control of the present invention permits use of a vacuum cleaner independent of and in conjunction with a portable electric tool. The vacuum cleaner control includes a vacuum cleaner control motor circuit including the motor for operating the vacuum cleaner. An electrical outlet is provided on the vacuum cleaner that is connected to the vacuum cleaner motor control circuit to enable a portable electric tool to be plugged into the vacuum cleaner electrical outlet. A three position ON/OFF/AUTOMATIC switch is provided on the vacuum cleaner for operating the vacuum cleaner motor control circuit. When the three position switch is in either an ON or OFF position, only the vacuum cleaner is energized or de-energized. However, when the three position switch is in the AUTOMATIC position, the vacuum cleaner motor control circuit is capable of being energized by the portable electric tool.

Both the electrical outlet for the portable electric tool and the three position ON/OFF/AUTOMATIC switch are mounted on the vacuum cleaner. This facilitates plugging the portable electric tool into the electrical outlet on the vacuum cleaner while enabling the three position switch to control independent or cooperative use of the vacuum cleaner with the portable electric tool.

The vacuum cleaner motor control circuit includes a delay for turning off the vacuum cleaner motor control circuit when the portable electric tool is turned off. The delay is operative after a predetermined time period in order to protect the vacuum cleaner motor control circuit components.

BRIEF DESCRIPTION OF THE DRAWINGS

Corresponding reference numerals will be used throughout the figures of the drawings for simplification purposes.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
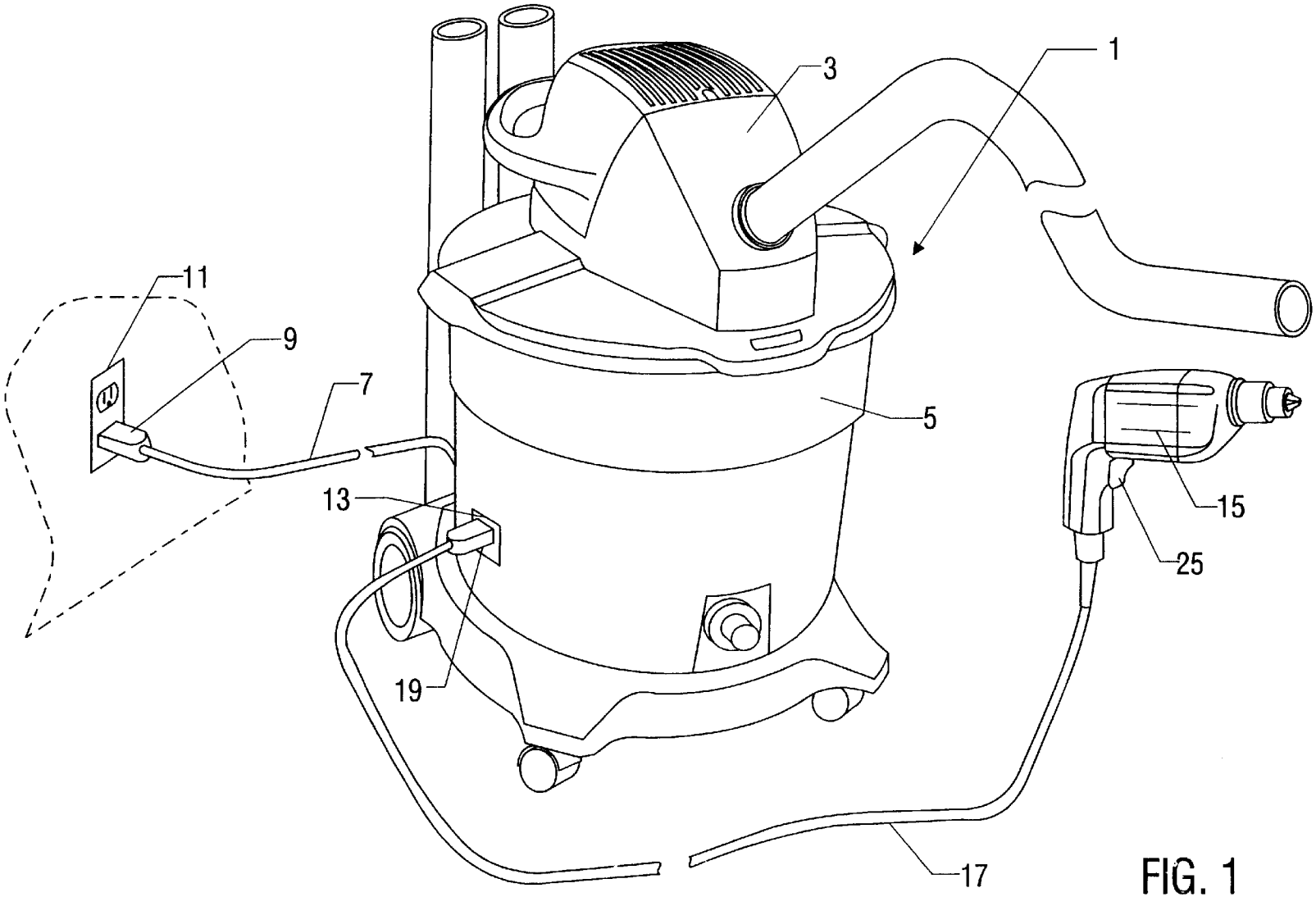
FIG. 1 is a perspective view of a blower mounted utility vacuum cleaner having a vacuum cleaner electrical outlet, which enables the plugging in of a portable electric tool, to facilitate operation of the vacuum cleaner independent of and in conjunction with the portable electric tool, as desired.

The portable electric tool vacuum cleaner control of the present invention is adapted for use with a vacuum cleaner such as the blower mounted utility vacuum cleaner 1 illustrated in FIG. 1 of the drawings. This type of utility vacuum cleaner 1 enables the blower 3 to be separated from the vacuum cleaner drum 5 or enables mounting of the blower 3 on the vacuum cleaner drum 5, as illustrated in FIG. 1. When separated from the vacuum cleaner drum 5, the blower 3 can be operated as a separate unit. For purposes of the present invention, the portable electric tool vacuum cleaner control of the present invention is operable when the blower 3 is mounted on the vacuum cleaner drum 5. It will also be appreciated that other types of vacuum cleaners, without a removable blower, may be used in conjunction with the portable electric tool vacuum cleaner control of the present invention.

For operating the utility vacuum cleaner 1, a three-wire power cord 7 has a plug 9 that is plugged into an appropriate electrical outlet 11 for powering the utility vacuum cleaner 1. It will be noted that the utility vacuum cleaner 1 also has an electrical outlet 13 mounted on the vacuum cleaner drum 5. The purpose of the electrical outlet 13 is to enable the portable electric tool 15 to be operated in conjunction with the vacuum cleaner 1, in order to facilitate dust collection at the time that the portable electric tool 15 is operated.

Figure 2:
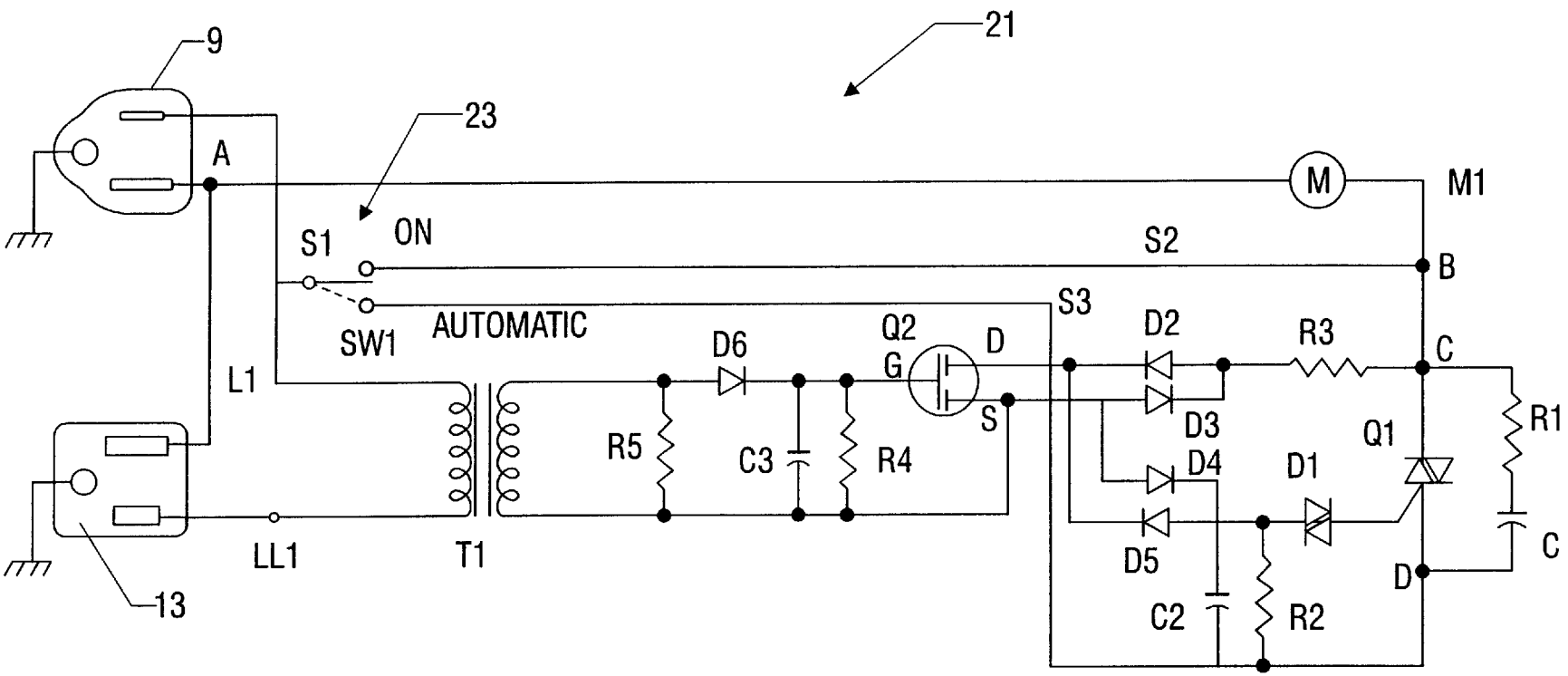
FIG. 2 is a schematic view of the vacuum cleaner motor control circuit that is used for operating the vacuum cleaner independent of and in conjunction with a portable electric tool, as desired.

The motor control circuit 21, which is shown in FIG. 2 of the drawings, enables independent operation of the vacuum cleaner 1 or joint operation of the vacuum cleaner 1 in conjunction with the portable electric tool 15, as may be desired. For this purpose, a three position ON/OFF/AUTOMATIC switch 23 is provided. When the three position switch 23 is in the ON position, the vacuum cleaner I will be operated and when the three position switch 23 is moved to the OFF position, the vacuum cleaner 1 will be de-energized. Thus, in either ON or OFF position of the three position switch 23, only the vacuum cleaner 1 is connected or disconnected through the three-wire power cord 7 to the electrical outlet 11 and a source of AC power (not shown).

When the three position switch is placed in its AUTOMATIC position, i.e. terminal S1 becomes electrically coupled to terminal SW1, the portable electric tool 15 is energized along with the vacuum cleaner 1 for joint operation. When the portable electric tool 15 is turned on by its trigger switch 25, current flowing in the circuit of the portable electric tool will turn on the vacuum cleaner motor control circuit 21. Similarly, when the portable electric tool 15 is turned off with this trigger switch 25, the vacuum cleaner motor control circuit 21 is also turned off, preferably after a time delay in order to protect the components in the motor control circuit 21.

In order to understand the operation of the portable electric tool 15 in conjunction with the vacuum cleaner 1 through the motor control circuit 21, a more detailed reference is made to FIG. 2 of the drawings.

As depicted in FIG. 2, the motor control circuit 21 is coupled to a vacuum motor M via a first motor terminal A and a second terminal B. The first motor terminal A is adapted to be coupled to a source of AC power from electrical outlet 11 via plug 9. A gated bi-directional semiconductor switch Q1, which in the preferred embodiment is a triac, couples to the second terminal B of the motor M via the switch's first terminal C. The switch Q1 is further adapted to be coupled, via its second terminal D, to the source of AC power through electrical outlet 11 when the switch Q1 is rendered in its conductive state by application of a current pulse to the gate of the switch Q1 and when switch 23 is in the appropriate state. Thus, when switch Q1 is in its conductive state, the motor M is rendered operative as a result of the current flow from the source of AC power via electrical outlet 11 to the motor M via the conductivity of switch Q1.

Current sensor circuitry, which comprises a transformer T1 and a rectifying diode D6, is provided for detecting the flow of electric current to the electric tool 15 and for generating a DC voltage signal having a magnitude corresponding to the magnitude of the current flowing to the electric tool 15. The transformer T1 has an input connected in series with the line providing power to the electric tool 15 and an output that provides a signal corresponding to the current flowing to the electric tool 15. The rectifying diode D6 has an input coupled to the output of the transformer T1 and an output that provides a DC signal having a magnitude that corresponds to the output magnitude of the transformer T1. A capacitor C3 is coupled to the output of the rectifying diode D6 to provide the DC signal and the capacitor C3 is sized such that the DC signal at the output of the capacitor remains above a predetermined voltage level for a predetermined time period after the flow of electric current to the power tool is halted.

In order to render the switch Q1 in its conductive state, circuitry is provided in the form of a full wave rectifier, a semiconductor switching device Q2, and an impedance circuit for applying a current pulse to the gate of the gated bidirectional semi-conductor switch Q1 when the DC voltage signal, generated from the current sensor circuitry, exceeds a predetermined value. The full wave rectifier, comprising diodes D2, D3, D4, and D5, has a first AC input electrically coupled to the first terminal C of the gated bidirectional semi-conductor switch Q1, via a resistor R3, and a second AC input electrically coupled to the gate of the bi-directional semi-conductor switch Q1, via a bi-directional breakdown diode D1. The full wave rectifier further includes first and second DC outputs adapted to provide DC power. The semi-conductor switching device (Q2), which in the preferred embodiment is a transistor, couples across the DC output terminals of the full wave rectifier and has a gate adapted to receive the DC voltage signal from the capacitor C3. The impedance circuit, comprising the parallel combination of resistor R2 and capacitor C2, has a first terminal coupled to the second AC input of the full wave rectifier and a second terminal coupled to the second terminal D of the gated bi-directional switch Q1. The bi-directional breakdown diode D1 is in its conductive state when the voltage across the breakdown diode D1 exceeds a preselected value, the preselected voltage being selected such that the breakdown diode D1 begins to conduct when the power applied to the diode D1 is such that the current flowing through the conducting diode will fully turn on the gated bi-directional semi-conductor switch Q1. In the illustrated embodiment D1 is a diac.

Plug 9 from the three wire power cord 7 is plugged into the electrical outlet 11 while the portable electric tool plug 19 is plugged into the vacuum cleaner electrical outlet 13. In order to move the three position switch 23 to its AUTOMATIC position, the switch 23 is moved to the dotted line position illustrated. This connects S1 with SW1 for connecting the portable electric tool 15 in the motor control circuit 21. Thus, providing that the switch 23 is in the AUTOMATIC position, when the portable electric tool 15 is energized by its trigger switch 25, AC current flows through the primary winding of transformer T1. This current induces a voltage in the secondary winding of transformer T1. Resistor R5 loads the secondary winding of transformer T1 such that the transformer T1 can be wound to send small currents drawn by small electric tools connected to the vacuum cleaner electrical outlet 13 (preferably 15A outlet), and yet excessive voltage which could damage the semiconductor switching device Q2 will not appear across the secondary winding of transformer T1 when larger electric power tools that draw higher current are connected to the vacuum cleaner mounted electrical outlet 13 (preferably 15A outlet). Rectifying diode D6 rectifies the voltage from the transformer T1. A capacitor C3 filters the rectified voltage from rectifying diode D6 and resistor R4 discharges capacitor C3 after the portable electric tool 15 is turned off. This creates a time delay in the turn-off of the vacuum cleaner motor M. When the voltage at D6, C3, R4, and terminal G of semiconductor switching device Q2 rises to the gating voltage of the switching device Q2, the terminals D and S are connected. This closes the gating circuit of the gated bi-directional semi-conductor switch Q1 through diodes D2, D3, D4 and D5 (as discussed above, in the illustrated embodiment Q1 is a triac). These diodes form a bridge circuit that allows alternating current in the gating circuit to flow through the semiconductor switching device Q2 as a pulsing DC current. Diodes D2 and D4 conduct during the positive half cycle and diodes D3 and D5 conduct during the negative half cycle. Resistors R3 and R2 form a voltage divider that causes the delay in the firing of bi-directional breakdown diode D1. Capacitor C2 charges during the delay until diode D1 fires and supplies sufficient current to insure complete turn-on of the gated bi-directional semi-conductor switch Q1. Resistor R1 and capacitor C1 form a snubber circuit to protect the switch Q1 from excessive dVdT. When the gated bi-directional semi-conductor switch Q1 is turned on, the motor M and the vacuum cleaner 1 is turned on.

Thus, the portable electric tool vacuum cleaner control of the present invention enables the portable electric tool 15 to be connected to the motor control circuit 21 as long as the three position switch 23 is in its AUTOMATIC position. This enables both the portable electric tool 15 and the vacuum cleaner 1 to be jointly operated for collecting dust during the operation of the portable electric tool 15, without concern for a separate turn-on or turn-off of the portable electric tool and vacuum cleaner, as is now required. When it is desired to operate the vacuum cleaner 1 solely, the three position automatic switch is moved to the ON position as shown in FIG. 2 which connects only the vacuum cleaner 1 through the motor control circuit. When the switch 23 is turned OFF, the vacuum cleaner is also only then turned off.

From the foregoing, it will now be appreciated that the present invention provides independent operation of a vacuum cleaner and joint operation of a vacuum cleaner in conjunction with a portable electric tool, as may be desired.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A vacuum assembly adapted for use with an electric tool, the vacuum assembly comprising:

a vacuum motor having a first motor terminal adapted to be coupled to a source of AC power and a second terminal;

a gated bi-directional semiconductor switch having a first terminal coupled to the second terminal of the vacuum motor and a second terminal adapted to be coupled to the source of AC power so as to provide a path for current to flow from the source of AC power through the vacuum motor when the switch is rendered conductive in response to the application of a current pulse to the gate of the switch;

a current sensor for detecting the flow of electric current to the electric tool and generating a DC voltage signal having a magnitude corresponding to the magnitude of the current flowing to the electric tool; and circuitry for applying the current pulse to the gate of the switch to render the switch conductive while the DC voltage signal exceeds a predetermined value, wherein the current providing the current pulse flows through the vacuum motor.

2. A vacuum assembly adapted for use with an electric tool, the vacuum assembly comprising:

a vacuum motor having a first motor terminal adapted to be coupled to a source of AC power and a second terminal;

a gated bi-directional semiconductor switch having a first terminal coupled to the second terminal of the vacuum motor and a second terminal adapted to be coupled to the source of AC power so as to provide a path for current to flow from the source of AC power through the vacuum motor when the switch is rendered conductive in response to the application of a current pulse to the gate of the switch;

a current sensor for detecting the flow of electric current to the electric tool and generating a DC voltage signal having a magnitude corresponding to the magnitude of the current flowing to the electric tool, wherein the current sensor comprises:

a transformer having an input connected in series with the line providing power to the electric tool and an output that provides a signal corresponding to the current flowing to the electric tool; and a rectifier, the rectifier having an input coupled to the output of the transformer and an output that provides a DC signal having a magnitude that corresponds to the output magnitude of the transformer; and circuitry for applying a current pulse to the gate of the switch to render the switch conductive while the DC voltage signal exceeds a predetermined value.

3. The vacuum assembly of claim 2 wherein the rectifier is a diode.

4. The vacuum assembly of claim 2 further comprising a capacitor coupled to the output of the rectifier, wherein the output of the capacitor is the DC signal and wherein the capacitor is sized such that the DC signal at the output of the capacitor remains above a predetermined voltage level for a predetermined time period after the flow of electric current to the power tool is halted.

5. The vacuum assembly of claim 1 wherein the gated bi-directional semiconductor switch is a triac.

6. A vacuum assembly adapted for use with an electrical tool, the vacuum assembly comprising:

a vacuum motor having a first motor terminal adapted to be coupled to a source of AC power and a second terminal;

a gated bi-directional semiconductor switch having, a first terminal coupled to the second terminal of the vacuum motor, and a second terminal adapted to be coupled to the source of AC power so as to provide a path for current to flow from the source of AC power through the vacuum motor when the switch is rendered conductive in response to the application of a current pulse to the gate of the switch;

a current sensor for detecting the flow of electric current to the electric tool and generating a DC voltage signal having a magnitude corresponding to the magnitude of the current flowing to the electric tool; and circuitry for applying a current pulse to the gate of the switch to render the switch conductive while the DC voltage signal exceeds a predetermined value, wherein the circuitry for applying a current pulse to the gate of the switch comprises:

a full wave rectifier having first and second AC inputs adapted to receive AC power and first and second DC outputs adapted to provide DC power, the first AC input being electrically coupled to the first terminal of the switch and the second AC input being electrically coupled to the gate of the switch;

a semiconductor switching device coupled across the DC output terminals of the full wave rectifier, the semiconductor switching device having a gate adapted to receive the DC voltage signal; and an impedance circuit having a first terminal coupled to the second AC input of the full wave rectifier and a second terminal coupled to the second terminal of the switch.

7. The vacuum assembly of claim 6 wherein the current sensor comprises:

a transformer having an input connected in series with the line providing power to the electric tool and an output that provides a signal corresponding to the current flowing to the electric tool; and a rectifier, the rectifier having an input coupled to the output of the transformer and an output that provides a DC signal having a magnitude that corresponds to the peak output magnitude of the transformer.

8. A method of energizing a vacuum motor in response to the energization of an electric tool, the vacuum motor being coupled to a source of electric power through a gated power semiconductor device, the method comprising the acts of:

detecting the flow of electric current to the electric tool and generating a DC voltage signal having a magnitude corresponding to the magnitude of the current flowing to the electric tool; and establishing a current path from the source of electric power through the vacuum motor to the gate of the gated power semiconductor device when the DC voltage exceeds a predetermined voltage level to render the gated power semiconductor device conductive and to energize the vacuum motor.

9. A method of energizing a vacuum motor in response to the energization of an electric tool, the vacuum motor being coupled to a source of electric power through a gated power semiconductor device, the method comprising the acts of:

detecting the flow of electric current to the electric tool and generating a DC Voltage signal having a magnitude corresponding to the magnitude of the current flowing to the electric tool;

establishing a current path between a source of electric power and the gate of the gated power semiconductor device when the DC voltage exceeds a predetermined voltage level to render the gated power semiconductor device conductive and to energize the vacuum motor; and wherein AC power is applied to the electric tool when the tool is energized and wherein the act of detecting the flow of electric current to the electric tool and generating the DC voltage signal having a magnitude corresponding to the magnitude of the current flowing to the electric tool comprises the acts of:

using a transformer to generate a low-voltage AC signal that is substantially in-phase with the AC power being applied to the electric tool, but that has a peak voltage magnitude that is substantially less than the peak voltage magnitude of the AC power being applied to the electric tool; and rectifying and filtering the low-voltage AC signal to provide the DC voltage signal.

10. The method of claim 8 further comprising the step of maintaining the magnitude of the DC voltage signal above a predetermined minimum level for a predetermined period of time after the electric tool is de-energized.

11. An improved vacuum assembly for use with a portable electric tool comprising:

a vacuum motor;

means for detecting energization of the portable electric tool and providing an output electric signal indicating that the portable electrical tool is energized;

means for receiving the output electric signal and generating DC power to apply a current pulse flowing through the vacuum motor; and semiconductor means coupled to receive the current pulse and to energize the vacuum motor.

* * * * *